US011241859B2

(12) United States Patent
Brivio et al.

(10) Patent No.: US 11,241,859 B2
(45) Date of Patent: Feb. 8, 2022

(54) PLANT FOR THE PRODUCTION OF CORRUGATED CARDBOARD

(71) Applicant: QUANTUMCORRUGATED S.R.L., Milan (IT)

(72) Inventors: Piero Alberto Brivio, Santa Margherita Ligure (IT); Renato Rossi, Biassono (IT)

(73) Assignee: QUANTUMCORRUGATED S.R.L., Milan (IT)

( * ) Notice: Subject to any disclaimer, the term of this patent is extended or adjusted under 35 U.S.C. 154(b) by 0 days.

(21) Appl. No.: 16/644,038

(22) PCT Filed: Jul. 31, 2018

(86) PCT No.: PCT/IB2018/055730
§ 371 (c)(1),
(2) Date: Mar. 3, 2020

(87) PCT Pub. No.: WO2019/048945
PCT Pub. Date: Mar. 14, 2019

(65) Prior Publication Data

US 2021/0060891 A1 Mar. 4, 2021

(30) Foreign Application Priority Data

Sep. 6, 2017 (IT) ..... 102017000099951

(51) Int. Cl.
*B31F 1/28* (2006.01)

(52) U.S. Cl.
CPC ..... *B31F 1/2813* (2013.01); *B31F 1/2818* (2013.01)

(58) Field of Classification Search
CPC ..... B31F 1/28; B31F 1/2813; B31F 1/2818; B31F 1/2822; B31F 1/2836; B31F 1/2845;
(Continued)

(56) References Cited

U.S. PATENT DOCUMENTS 5,662,765 A * 9/1997 Titz ..... B31F 1/285 156/470
5,861,083 A * 1/1999 Klockenkemper ..... B31F 1/284 162/263
(Continued)

FOREIGN PATENT DOCUMENTS

EP 2792478 A1 10/2014
GB 2211216 A * 6/1989 ..... B31F 1/2836
(Continued)

*Primary Examiner* — Valentin Neacsu
*Assistant Examiner* — Jacob A Smith
(74) *Attorney, Agent, or Firm* — Volpe Koenig

(57) ABSTRACT

A plant (10) for the production of corrugated cardboard comprising: a corrugating unit (36) adapted to produce containerboard, and a double baker (60) adapted to receive the containerboard. The corrugating unit (36) is positioned in proximity to an output end (66) of the double baker (60). The plant (10) further comprises a transfer unit (72) adapted to receive the containerboard and move it. The transfer unit (72) comprising: an input end (722) for the containerboard positioned in proximity to the corrugating unit (36), and an output end (724) for the containerboard positioned in proximity to an input end (64) of the double baker (60).

9 Claims, 2 Drawing Sheets

(58) Field of Classification Search
CPC ..... B31F 1/285; B31F 1/20; B31F 1/2804; B31F 1/284
USPC ..... 493/328, 331, 332, 334, 335, 336, 337
See application file for complete search history.

(56) References Cited

U.S. PATENT DOCUMENTS

| | | | | |
|---|---|---|---|---|
| 2004/0182504 | A1* | 9/2004 | Stadele | B31F 1/2822 156/210 |
| 2015/0224733 | A1* | 8/2015 | Hagler | B31F 5/04 156/64 |
| 2018/0079162 | A1* | 3/2018 | Adami | B31F 1/2863 |
| 2018/0099472 | A1* | 4/2018 | Gnan | B65H 21/00 |
| 2019/0084266 | A1* | 3/2019 | Grunwald | B31F 1/2831 |

FOREIGN PATENT DOCUMENTS

| | | | |
|---|---|---|---|
| GB | 2211216 | A | 6/1989 |
| WO | 2017036685 | A1 | 3/2017 |

* cited by examiner

PLANT FOR THE PRODUCTION OF CORRUGATED CARDBOARD

TECHNICAL FIELD

The present invention relates to a plant for the production of corrugated cardboard.

PRIOR ART

Prior art plants for the production of corrugated cardboard comprise one or more corrugating assemblies, each of which is adapted to provide a composite sheet, indicated with the technical term "containerboard", comprising a corrugated sheet coupled, for example glued, to a flat sheet.

Coupling assemblies of the plant assemble the corrugated cardboard by coupling, for example gluing, together one or more containerboards and, typically, a cover sheet, indicated with the technical term "cover", to form the corrugated cardboard.

The plant also comprises double bakers adapted to stabilise the coupling between the sheets. For example, the double baker comprises heating plates and a pressing mat or rollers able to heat and press the corrugated cardboard, respectively, to consolidate the gluing between the sheets that comprise it.

To assure a stable coupling of the sheets that comprise a corrugated cardboard, it is necessary to adequately heat the sheets. In particular, even the sheets that are farthest away from a heat source of the double baker must receive a sufficient quantity of heat to assure a correct mutual fastening of the sheets, removing humidity therefrom and drying a glue applied by the coupling assemblies.

However, the intensity of the heat generated by the heat source to heat the farthest sheets can deteriorate the sheets of the corrugated cardboard that are closest to the heat source. Moreover, an inconsistent distribution of the heat, due to the thickness of the multilayer corrugated cardboard can lead to its deformation, due to a non-homogeneous evaporation of the humidity contained in the sheets, which can cause the formation of bubbles or warping in the multilayer corrugated cardboard.

Consequently, known plants comprise one or more additional heating, and possibly humidifying elements, to maintain uniform heat and humidity conditions, suitable to promote a correct coupling between the sheets. However, these additional elements increase the bulk of the plant, complicate its design and implementation, and in general increase its cost.

The above drawbacks affect in particular the plants for the production of multi-layer or multi-wave corrugated cardboard, i.e. comprising one or more containerboards. Therefore, in the prior art several contrivances have been proposed to overcome said drawbacks. For example, plants for the production of multilayer corrugated cardboard have been proposed in which different double bakers are adapted to stabilise the coupling of a corresponding part of the sheets previously coupled by a respective coupling assembly. In this way, each double baker has to heat a reduced number of sheets and hence generates a smaller intensity of heat, more easily controllable to obtain a consistent removal of humidity on a reduced number of sheets.

However, the implementation of multiple coupling assemblies and double bakers, each dedicated to coupling and fastening, respectively, one part of the sheets that comprise the multilayer corrugated cardboard, increases complexity, cost and bulk of the plant.

SUMMARY OF THE INVENTION

One object of the present invention is to overcome the aforementioned drawbacks of the prior art, within the scope of a solution that is simple, rational and with low cost.

These objects are attained by the features of the invention set out in the independent claim. The dependent claims outline preferred and/or particularly advantageous aspects of the invention.

One aspect of the solution in accordance with the present invention makes available a plant for the production of corrugated cardboard comprising: a corrugating unit adapted to produce a containerboard, and a double baker adapted to receive the containerboard. The corrugating unit is positioned in proximity to an output end of the double baker. The plant further comprises a transfer assembly adapted to receive the containerboard and to move it. The transfer assembly comprising: an input end for the containerboard positioned in proximity to the corrugating unit, and an output end for the containerboard positioned in proximity to an input end of the double baker.

Thanks to this solution it is possible to produce corrugated cardboard of high quality implementing a reduced number of operating assemblies and with an extremely compact structure.

In one embodiment, the transfer assembly is positioned externally to the double baker.

Thanks to this solution, a reduction of a linear extension of the plant is obtained.

In one embodiment, the double baker comprises a second transfer unit distinct from the transfer assembly. Preferably, the second transfer unit is adapted to move the containerboard through the double baker from the respective input end to the respective output end thereof.

In this way, it is possible to move the containerboard along the plant until the obtainment of the multilayer corrugated cardboard.

In one embodiment, the transfer assembly is adapted to receive the containerboard from the second corrugating unit to the input end and to move the containerboard from the respective input end to the respective output end of the transfer assembly.

Thanks to this solution it is possible to move the containerboard with precision and in a direction that is substantially opposed to the direction of sliding of the corrugated cardboard.

In one embodiment, the transfer assembly is adapted to receive and to move the containerboard with the corrugated sheet oriented towards a support plane of the transfer assembly.

In this way, it is possible to contain more effectively a dispersion of humidity and heat from the containerboard. Moreover, an operation of alignment of the sheets of the containerboard is simplified.

In one embodiment, the plant further comprises pressing elements adapted to maintain the containerboard stretched on the transfer assembly during its movement.

Thanks to this solution it is possible to obtain particularly effective movement and alignment of the containerboard sheets.

In one embodiment, the plant further comprises an additional corrugating unit adapted to produce additional containerboard. Preferably, the additional corrugating unit being positioned in proximity to the input end of the double baker.

In this way, a plant for the production of multilayer corrugated cardboard of high quality is obtained implementing a reduced number of operating assemblies and with an extremely compact structure.

In one embodiment, the plant further comprises a pair of corrugating assemblies. Each corrugating assembly comprises: a respective corrugating unit and a pair of sheet storing units. Each storing unit is adapted to supply a respective sheet to the corrugating unit. Preferably, the transfer assembly is superposed to a portion of a first corrugating assembly and a portion of a second corrugating assembly of the pair of corrugating assembly.

In this way, a further reduction of a linear extension of the plant is obtained. In one embodiment, the corrugating assemblies are arranged in sequence with respective storing units positioned adjacent to each other. Preferably, the transfer assembly is superposed to the mutually adjacent storing units.

In this way, it is possible to obtain a particularly efficient and compact disposition of the corrugating assemblies.

In one embodiment, the plant further comprises a gluing assembly to apply a glue on a surface of a corrugated sheet included in the containerboard. Preferably, the plant comprises an idler roller positioned in proximity both to the output end of the transfer assembly and to the gluing station. Still more preferably, the idler roller is adapted to receive the containerboard from the transfer assembly and to supply the containerboard to the gluing station.

Thanks to this solution it is possible to orient the containerboard optimally for the gluing operation.

In one embodiment, each corrugating assembly comprises an additional idler roller positioned between the corrugating assembly and a storing unit. Preferably, the idler roller is positioned superposed to the additional idler roller of the corrugating assembly comprising the corrugating unit positioned in proximity to the input end of the double baker.

In this way, an extremely compact implementation of the idle roller is obtained in the plant.

BRIEF DESCRIPTION OF THE DRAWINGS

Further characteristics and advantages of the invention shall become readily apparent from reading the following description, provided by way of non-limiting example, with the aid of the figures illustrated in the accompanying drawings.

BEST WAY TO EMBODY THE INVENTION

Figure 1:
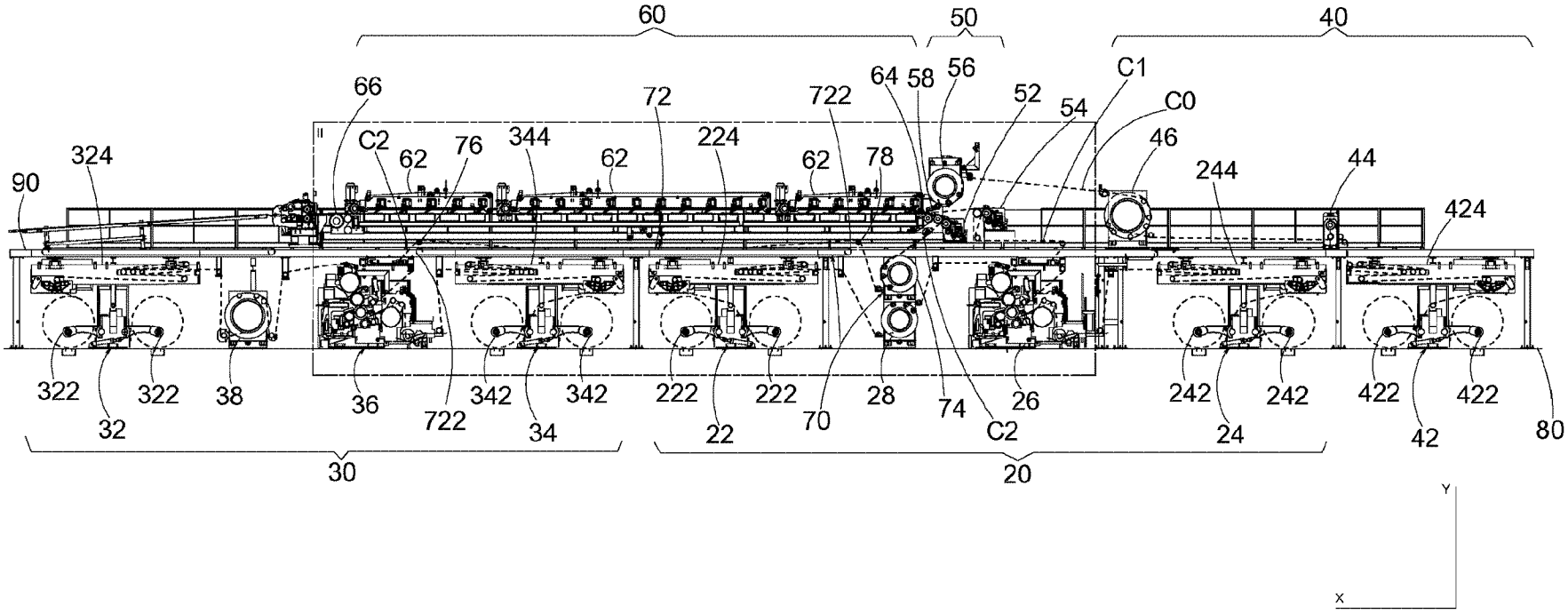
FIG. 1 is a cross-sectional side view of a portion of a plant for the production of corrugated cardboard in accordance with one embodiment of the present invention.

With particular reference to the figures, the numeral 10 globally indicates a plant for the production of corrugated cardboard, indicated with the term plant 10 hereafters for brevity.

In the non-limiting example of the figures, the plant 10 is preferably adapted to produce corrugated cardboard with multiple layers, or multilayer. The plant 10 according to one embodiment of the present invention is adapted to produce a multilayer corrugated cardboard comprising two corrugated sheets, which is also indicated as corrugated cardboard with double wave.

The plant 10 comprises a first corrugating assembly 20 and a second corrugating assembly 30, each adapted to form a respective composite sheet, indicated with the technical term 'containerboard', each comprising the corrugated sheet coupled with a corresponding flat sheet.

The first corrugating assembly 20 comprises one (first) corrugating unit 26 to form a first containerboard $C_1$. The corrugating unit 26 comprises one pair of corrugating rollers 262 and 264 to corrugate one sheet, a gluing station 266 to apply a glue on a sheet and a pressure roller 268 to bring a pair of sheets in contact.

In addition, the corrugating unit 26 comprises a heating device. Advantageously, the heating device can be integrated in another component of the corrugating unit 26, such as, for example, one or both the corrugating rollers 262 and 264.

The first corrugating assembly 20 comprises a first storing unit 22 and a second storing unit 24 for flat sheet. Each storing unit 22 and 24 comprises at least one reel support arm 222 and 242, respectively, adapted to receive and rotatably support a reel of sheet (indicated by a dashed line in the figures). In the example considered, each storing unit 22 and 24 comprises a pair of reel support arms 222 or 242. In addition, each storing unit 22 and 24 comprises a respective dispensing assembly 224 and 244 adapted to receive the sheet (indicated by a dashed line in the figures) from the reel support arms 222 or 242, and dispense it at the output in a preferably continuous manner.

The corrugating unit 26 is preferably positioned between the storing units 22 and 24.

Preferably, the first corrugating assembly 20 also comprises an idler roller 28. The idler roller 28 is positioned between the storing unit 22 and the corrugating unit 26.

Optionally, the idler roller 28 can comprise a heating device adapted to heat the sheet in contact with the roller to a respective predetermined temperature. In an alternative embodiment (not shown), the first corrugating assembly 20 is replaced by a containerboard assembly. The containerboard assembly is adapted to store and dispense a preformed containerboard to other assemblies of the alternative plant, such as a coupling assembly 50 or a double baker 60 described below. For example, the containerboard assembly comprises a storing unit, similar to the storing units 22 and 24, with one or more arms to support a reel of containerboard and a dispensing assembly adapted to dispense the containerboard. Preferably, the containerboard assembly can comprise one or more idler rollers. Advantageously, the containerboard assembly comprises one or more heating and/or humidifying units (for example, integrated with an idler roller) to bring the containerboard to optimal conditions for coupling.

The second corrugating assembly 30 comprises one (second) corrugating unit 36 to form a second containerboard $C_2$. The corrugating unit 36 comprises one pair of corrugating rollers 362 and 364 to corrugate one sheet, a gluing station 366 to apply a glue on a sheet and a pressure roller 368 to bring a pair of sheets in contact.

In addition, the corrugating unit 36 comprises a heating device. Advantageously, the heating device can be integrated in another component of the corrugating unit 36, such as, for example, one or both the corrugating rollers 362 and 364.

The second corrugating assembly 30 further comprises a first storing unit 32 and a second storing unit 34 for flat sheet. Each storing unit 32 and 34 comprises at least one reel support arm 322 and 342, respectively, adapted to receive and rotatably support a reel of sheet (indicated by a dashed line in the figures). In the example considered, each storing unit 32 and 34 comprises a pair of reel support arms 322 or 342. In addition, each storing unit 32 and 34 comprises a respective dispensing assembly 324 and 344 adapted to receive the sheet (indicated by a dashed line in the figures) from the reel support arms 322 or 342, and dispense it at the output in a preferably continuous manner. The corrugating unit 36 is preferably positioned between the storing units 32 and 34.

Preferably, the second corrugating assembly 30 also comprises an idler roller 38. The idler roller 38 is positioned between the storing unit 32 and the corrugating unit 36.

Optionally, the idler roller 38 can comprise a heating device adapted to heat the sheet in contact with the roller to a respective predetermined temperature. In an alternative embodiment (not shown), the second corrugating assembly 30 is replaced by the containerboard assembly in a similar manner to the one described above in relation to the first corrugating assembly.

Preferably, the plant 10 also comprises a cover assembly 40 adapted to supply and additional flat sheet, indicated with the technical term 'cover' $C_0$.

The cover assembly 40 comprises a storing unit 42 for the cover $C_0$. The storing unit 42 comprises at least one reel support arm 422 adapted to receive and rotatably support a reel of sheet (indicated by a dashed line in the figures). In the example considered, the storing unit 42 comprises a pair of reel support arms 422. In addition, the storing unit 42 comprises a dispensing assembly 424. The dispensing assembly 424 is adapted to receive the cover $C_0$ from the reels positioned on the corresponding reel support arms 422 and to dispense it at the output in a preferably continuous manner.

The cover assembly 40 also comprises at least one idler roller adapted to receive the cover $C_0$ from the storing unit 42. In the example considered, the cover assembly 40 comprises a pair of idler rollers 44 and 46. Optionally, at least one idler roller, for example the idler roller 46, can comprise a heating device adapted to heat the cover $C_0$ in contact with the roller to a respective predetermined temperature.

In addition, the plant 10 comprises a coupling assembly 50 which receives the containerboards from the corrugating assemblies 20 and 30, and the cover $C_0$ from the cover assembly 40 and couples them to obtain the multilayer corrugated cardboard.

The coupling assembly 50 comprises a first gluing station 52 and a positioning guide 58. Preferably, the coupling assembly 50 also comprises a second gluing station 54 and an idler roller 56.

A double baker 60 is positioned adjacent to the coupling assembly 50 and it is able to stabilise, or consolidate, the coupling between the first containerboard $C_1$ and the second containerboard $C_2$ and, in addition, between the cover sheet and the first containerboard $C_1$. For example, the double baker 60 comprises one or more double baker units 62. Each double baker unit 62 comprises heating elements and pressing elements (not shown in detail in the figures) to heat the multilayer corrugated cardboard to a predetermined temperature, and to apply a predetermined pressure to the multilayer corrugated cardboard, respectively.

Moreover, the double baker 60 comprises a conveyor unit (not shown in detail in the figures) adapted to transport, or convey, the multilayer corrugated cardboard, i.e. the containerboards $C_1$, $C_2$ and the cover $C_0$ (coupled), through the double baker 60 from an input end 64 to an output end 66 thereof. Consequently, the conveyor unit of the double baker 60 places under traction also the first containerboard $C_1$, the second containerboard $C_2$ and the cover $C_0$ coming from assemblies upstream of the double baker 60 relative to the sliding direction of the multilayer corrugated cardboard. In one embodiment, the conveyor unit of the double baker 60 can comprise a conveyor mat or belt which extends throughout, or over part of, the length of the double baker. Alternatively, a pair of mutually opposite conveyor belts between which passes the multilayer corrugated cardboard. For example, the conveyor unit can be integrated in one of the double baker units 62, preferably, in the double baker unit situated in proximity to the output end 66 of the double baker 60. Alternatively, the conveyor unit of the double baker 60 can comprise a plurality of conveyor belts, or of opposite pairs of conveyor belts. For example, each corresponding to the extension of one of the double baker units 62, preferably integrated therewith, and arranged in sequence to each other for the extension of the double baker 60.

In the solution in accordance with embodiments of the present invention at least one corrugating unit, the second corrugating unit 36 in the example in the figure, is positioned in proximity to the output end 66 of the double baker 60, while the first corrugating unit 26 is positioned in proximity to the input end 64 of the double baker 60, with the output end 66 opposite to the input end 64. Preferably, the coupling assembly 50 is also positioned in proximity to the input end 64 of the double baker 60.

In the present description, the term 'proximity' indicates a relative spatial relationship between elements of the plant 10. In particular, the second corrugating unit 36 is defined in proximity to the output end 66 of the double baker 60 inasmuch as a distance between the second corrugating unit 36 and the output end 66 is shorter than a distance between the second corrugating unit 36 and the input end 64. Similarly, the first corrugating unit 26 is in proximity to the input end 64 of the double baker 60 inasmuch as a distance between the first corrugating unit 26 and the input end 64 is shorter than a distance between the first corrugating unit 26 and the output end 66.

In the solution in accordance with embodiments of the present invention, the plant also comprises a transfer assembly 70 adapted to receive the second containerboard $C_2$ and supply it to the coupling assembly 50.

The transfer assembly 70 comprises a transfer unit 72 and, preferably, an idler roller 74.

In the embodiment illustrated in the figures, the transfer assembly comprises one input end 722 situated in proximity to the corrugating unit 36 of the second corrugating assembly 30 and one output end 724, opposite to the input end 722, situated in proximity to the input end 64 of the double baker 60 and at the idler roller 74, if provided. Advantageously, the output end 724 is also situated in proximity to the coupling assembly 50.

In particular, the input end 722 of the transfer assembly 70 is defined in proximity to the second corrugating unit 36 inasmuch as a distance between the input end 722 and the second corrugating unit 36 is shorter than a distance between the output end 724 and the second corrugating unit 36. Similarly, the output end 724 of the transfer assembly 70 is defined in proximity to the input end 64 of the double baker 60 inasmuch as a distance between the output end 724 of the transfer assembly 70 and the input end 64 of the double baker 60 is shorter than a distance between the output end 724 of the transfer assembly 70 and the output end 66 of the double baker 60.

The transfer unit 72 comprises means adapted to receive the second containerboard $C_2$ and to move it. Preferably, the transfer unit 72 comprises a conveyor mat or belt adapted to move the second containerboard $C_2$. For example, the conveyor belt comprises a transport belt and mechanical actuation means, such as an electric motor and one or more rotation rollers and/or pulleys, not detailed in the figures) able to impose a movement to the conveyor belt.

Advantageously, the transfer unit 72 can comprise one or more pressure elements such as pressing rollers, and/or others such as plates, adapted to maintain the second containerboard $C_2$ stretched on a sliding surface of the transfer unit, for example a surface of the conveyor belt, during the movement thereof.

Alternatively or additionally, to the aforementioned pressing elements, the conveyor belt can comprise a perforated transport belt and vacuum-generating means (for example, a pump and/or fans) adapted to create a negative pressure difference between a space delimited by the conveyor belt and the external environment so as to exercise a suction on the containerboard positioned on the belt. As a further alternative or addition, the conveyor belt can comprise means adapted to emit compressed air to create such a flow of air (or other fluid) as to maintain the second containerboard $C_2$ stretched on the conveyor belt.

Preferably, the transfer assembly 70 also comprises a pair of rollers 76 and 78 positioned in proximity to the input end 722 and output end 724 of the transfer unit 72 adapted to straighten and/or direct the second containerboard $C_2$ entering into and exiting out of the transfer unit 72.

Figure 2:
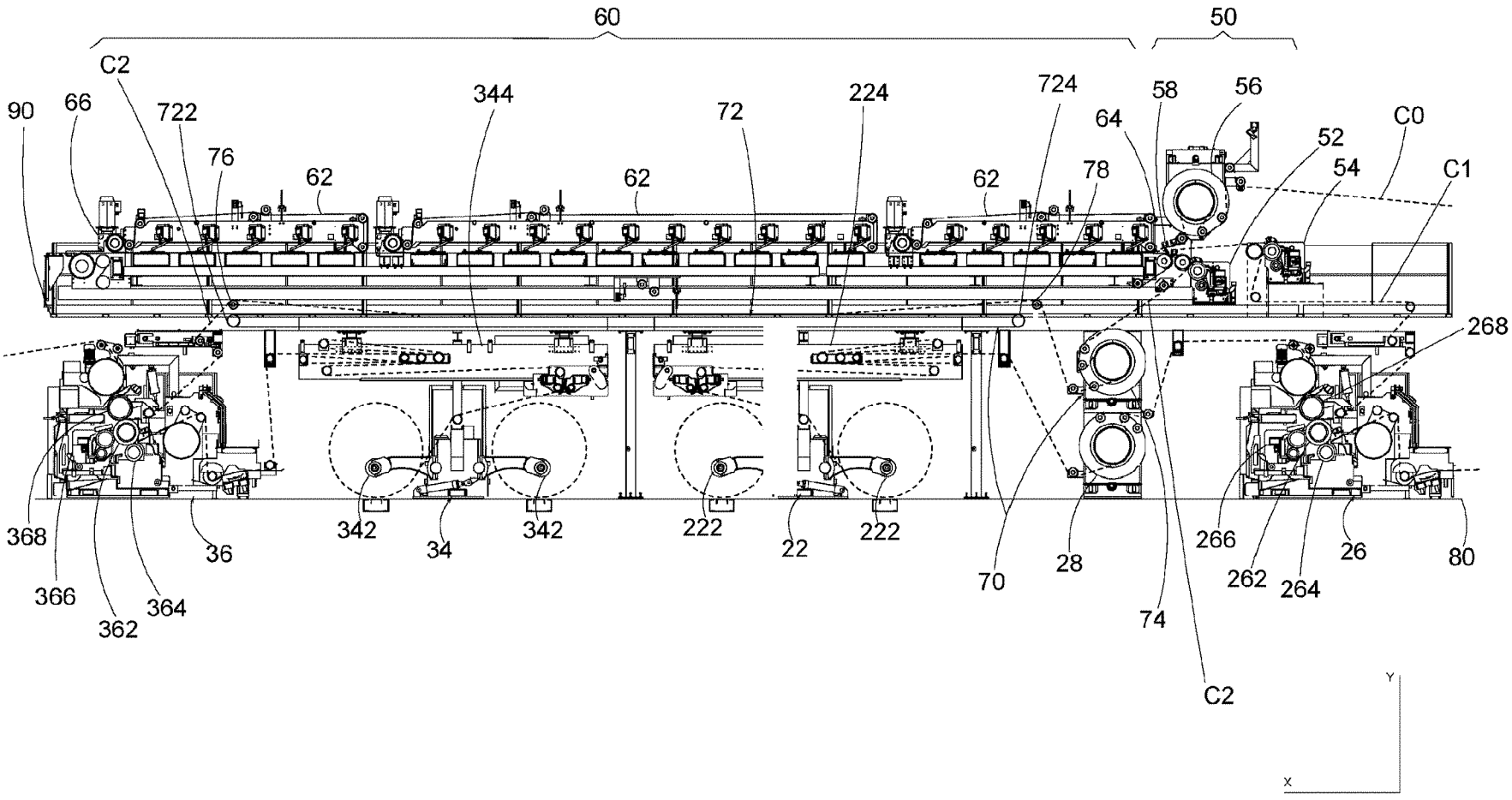
FIG. 2 is an enlargement of the detail II of the plant of FIG. 1.

In the embodiments of the present invention, the corrugating assemblies 20 and 30 are arranged according to a linear sequence, o in line, in the plant 10. In the example of FIGS. 1 and 2, the linear sequence comprises the first corrugating assembly 20 followed by the second corrugating assembly 30, considering a sliding direction (i.e. from right to left with reference to FIGS. 1 and 2—imposed by the conveyor unit of the double baker 60) of the multilayer corrugated cardboard produced by the plant 10.

Preferably, the storing unit 42 of the cover assembly 40 can be placed in an initial position of the linear sequence, i.e. upstream of the first corrugating assembly 20, relative to the sliding direction of the multilayer corrugated cardboard produced by the plant 10.

Such a linear sequence is installed, for example, on a base surface 80 and forms a first layer or level of the plant 10.

In the embodiment illustrated in the figures, the idler roller 74 of the transfer assembly 70 is positioned in the first level of the plant 10. Preferably, the idler roller 74 is positioned in proximity to the output end 724 of the transfer unit 72, of the coupling assembly 50 and of the input end 64 of the double baker 60. For example, the idler roller is superposed to, for example mounted on, the idler roller 28 of the first corrugating assembly 20.

In the present description, the term 'superposed' means a spatial relationship between elements relative to a direction (indicated with the letter Y in the figures) substantially perpendicular to the linear development of the plant 10. In particular, the term 'superposed' indicates at least a partial coincidence, i.e. an overlap, of plan view sizes of two or more elements of the plant 10, but does not necessarily imply that an element superposed to another element is also supported by the latter. In other words, two or more elements of the plant 10 are considered superposed if their respective plan view sizes lie, at least partially, in a same portion of plan view surface.

In the embodiment considered, a support frame 90 supports the coupling assembly 50, the double baker 60 and at least the transfer unit 72 of the transfer assembly 70 in a position superposed to the linear sequence and forms a second layer or level of the plant 10.

In the solution in accordance with embodiments of the present invention the double baker 60 is positioned superposed to the transfer assembly 70. Preferably, the double baker 60 is superposed at least to the transfer unit 72 of the transfer assembly 70. In other words, a plan view size of the double baker 60 coincides, i.e. is superposed, at least partially to the plane view size of the transfer unit 72 of the transfer assembly 70.

It will be readily apparent to the person skilled in the art that the transfer assembly 70 and the double baker 60, although superposed, remain two separate and mutually independent entities. In particular, the transfer unit 72 of the transfer assembly 70 is an element of the plant 10 separate and distinct from the additional conveyor unit included in the double baker 60. In other words, the transfer unit 72, and in general the entire transfer assembly 70, is positioned externally to the double baker 60.

Moreover, the input end 722 of the transfer unit 72 of the transfer assembly 70 is positioned in proximity to the output end 66 of the double baker 60 and, vice versa, the output end of the transfer unit 72 of the transfer assembly 70 is positioned in proximity to the input end 64 of the double baker 60.

Advantageously, the transfer unit 72 of the transfer assembly 70 can be integrated in the support frame 90, as illustrated in the example considered, so as to contain a size in elevation of the plant 10.

In the embodiment of FIGS. 1 and 2, the second level of the plant 10 also comprises the idler rollers 44 and 46 of the cover assembly 40.

Preferably, the coupling assembly 50 is superposed to the first corrugating assembly 20. In other words, the coupling assembly 50 is positioned in the second level of the plant at the first coupling assembly 20, which is positioned at the first level of the plant, preferably in proximity to the input end 64 of the double baker 60. For example, a plan view size of the coupling assembly 50 coincides, or is superposed, in the plan view size of the first corrugating assembly 20. Preferably, the plan view size of the coupling assembly 50 is included in a portion of the plan view size of the first corrugating assembly which extends from the corrugating assembly 26 to the idler roller 28 of the first corrugating assembly 20.

Otherwise, the transfer assembly 70 is positioned in the second level in such a way as to extend from the second corrugating assembly 30 to the coupling assembly 50. Consequently, the transfer assembly 70 is superposed to part of the corrugating assemblies 20 and 30 positioned in the first level of the plant 10. In the embodiment illustrated in the figures, the transfer unit 72 of the transfer assembly 70 is superposed to the storing unit 22 of the first corrugating assembly 20 and to the storing unit 34 of the second corrugating assembly 30 which are positioned adjacent to each other.

The double baker 60, being superposed to the transfer assembly 70 is, similarly, at least partially superposed to the corrugating assemblies 20 and 30 underlying the transfer assembly 70.

In light of the above description, the operation of the plant 10 is as follows.

In the first corrugating assembly 20, the sheets on the arms 222 and 242 of the storing units 22 and 24, respectively, are unreeled and transferred to the respective dispensing assemblies 224 and 244. The sheet exiting from the storing unit 22—i.e., the flat sheet of the first containerboard $C_1$—is received by idler roller 28 which directs it to a first inlet of the corrugating unit 26, while the sheet exiting from the storing unit 24—i.e., the sheet to be corrugated—is received at a second input of the corrugating unit 26.

The sheet to be corrugated traverses the pair of corrugating rollers 262 and 264 whereby it is corrugated and, possibly, heated.

Subsequently, the gluing station 266 applies a layer of glue on the corrugated sheet that emerges from the pair of corrugating rollers 262 and 264. Preferably, the gluing station 266 deposits a layer of glue on convex portions of a surface of the corrugated sheet oriented towards the gluing station 266.

The corrugated sheet is then coupled to the flat sheet to form the first containerboard $C_1$. The pressing roller 268 brings in contact and presses the flat sheet against the corrugated sheet. In particular, the flat sheet is brought in contact with the surface of the corrugated sheet on which the glue has been applied.

The first containerboard $C_1$ emerges from an output of the corrugating unit 26 to be transferred to the second gluing station 54 of the coupling assembly 50. The second corrugating assembly 30 operates in a manner that substantially corresponds to what has just been described and substantially in parallel to the first corrugating assembly 20. The sheets on the arms 322 and 342 of the storing units 32 and 34, respectively, are unreeled and transferred to the respective dispensing assemblies 342 and 344. The sheet exiting the storing unit 32—i.e., the flat sheet of the second containerboard $C_2$—is received by the idler roller 38 that directs it to a first input of the corrugating unit 36, while the sheet exiting from the storing unit 34—i.e., the sheet to be corrugated—is received at a second input of the corrugating unit 36.

The sheet to be corrugated traverses the pair of corrugating rollers 362 and 364 whereby it is corrugated and, possibly, heated.

Subsequently, the gluing station 366 applies a layer of glue on the corrugated sheet that emerges from the pair of corrugating rollers 362 and 364. Preferably, the gluing station 366 deposits a layer of glue on convex portions of a surface of the corrugated sheet oriented towards the gluing station 336.

The corrugated sheet is then coupled to the flat sheet to form the second containerboard $C_2$. The pressing roller 368 brings in contact and presses the flat sheet against the corrugated sheet. In particular, the flat sheet is brought in contact with the surface of the corrugated sheet on which the glue has been applied.

The second containerboard $C_2$ thus obtained is output to the corrugating unit 36 and it is received by the transfer assembly 70.

In the solution in accordance with embodiments of the present invention, the transfer unit 72 receives the second containerboard $C_2$ at the input end 722, positioned in proximity to the corrugating unit 36, and moves it to the second end 724 in proximity to the idler roller 74. In other words, the transfer unit 72 transports the second containerboard $C_2$ in a direction opposite to the sliding direction of the multilayer corrugated cardboard in the plant 10.

Advantageously, one free surface of the corrugated sheet, i.e., not coupled to the flat sheet, is oriented towards the support plane of the transfer unit 72 during the sliding of the second containerboard $C_2$.

The movement of the second containerboard $C_2$ on the transfer unit 72, makes it possible to contain a dispersion of humidity and heat accumulated in the containerboard during the coupling of the two sheets in the corrugating unit 36. Thanks to the orientation of the second containerboard $C_2$ on the transfer unit 72, i.e. with the portions of corrugating unit and flat sheet glued to each other opposite to the support plane of the transfer unit 72, an improved and particularly effective containment is obtained of the dispersion into the environment of humidity and heat from the second containerboard $C_2$, in particular of the humidity and heat associated to the corrugated sheet of the second containerboard $C_2$. In this way, it is possible to proceed with coupling and stabilising the coupling between the containerboard with no need to provide additional heating/humidification at the coupling assembly 50 to restore humidity and heat dispersed from the second containerboard $C_2$ during the transfer from the corrugating unit 36 to the coupling assembly 50 in proximity to the input end 64 of the double baker 60. In other words, the plant 10 in accordance with embodiments of the present invention provides the first containerboard $C_1$ and the second containerboard $C_2$ with suitable, preferably optimal humidity and heat levels, to obtain a reliable mutual coupling; in particular, the gluing and subsequent consolidation are particularly efficient without providing any additional heat or humidity to the containerboard.

In one embodiment in accordance with the present invention, a velocity of the sliding unit 72, for example a velocity of revolution of the belt, is set higher, for example slightly higher, than a velocity of the conveyor unit of the double baker 60. In this way, a sliding effect is obtained of the second containerboard $C_2$ through the sliding unit 72, which makes it possible to maintain a correct alignment between the corrugated sheet and the flat sheet of the second containerboard $C_2$. In this way, it is possible to correct any misalignments of the second containerboard $C_2$ before coupling it to the first containerboard $C_1$, however without reducing a tensioning of the second containerboard $C_2$. In addition, the sliding unit 72, and possibly the pair of rollers 76 and 78, make it possible to maintain the second containerboard under tension, in particular at a predetermined tension, during the transit through the transfer assembly 70, until reaching the double baker 60.

The idler roller 74 of the transfer assembly 70 receives the second containerboard $C_2$ which emerges from the output end 724 of the transfer unit 72 and transfers it to the coupling assembly 50. In particular, the idler roller 74 deflects the second containerboard $C_2$ so as to orient the free surface of the corrugated sheet in favour of the first gluing station 52 of the coupling assembly 50.

The cover assembly 40 operates substantially in parallel to the corrugating assemblies 20 and 30. The cover $C_0$ on the arms 422 of the storing unit 42 of the cover assembly 40 is unreeled and transferred to the dispensing assembly 424. The cover $C_0$ exiting the dispensing assembly 424 is received by the idler roller 44 which directs it to the idler roller 46 which, in turn, directs it to the idler roller 56 of the coupling assembly 50.

In the coupling assembly 50, each gluing station 54 and 52 applies a layer of glue on the first and second containerboard $C_2$, respectively. Preferably, the first and the second gluing station 52 and 54 deposit a layer of glue on convex portions of the free surface of the corrugated sheet of the second and first containerboard $C_2$ and $C_1$, respectively.

The first containerboard $C_1$, the second containerboard $C_2$ and the cover $C_0$ are input to the positioning guide 58 which aligns the sheets and brings them in mutual contact to form the multilayer corrugated cardboard.

The positioning guide 58 brings into contact the flat sheet of the first containerboard $C_1$ against the corrugated sheet of the second containerboard $C_2$. In detail, the flat sheet of the first containerboard $C_1$ is brought into contact with the free surface of the corrugated sheet of the second containerboard $C_2$ on which the glue was applied, to glue containerboards to each other.

In addition, the positioning guide 58 brings the cover $C_0$ into contact with the corrugated sheet of the first containerboard $C_1$. In detail, the cover $C_0$ is brought into contact with the free surface of the corrugated sheet of the first containerboard $C_1$ on which the glue was applied, to glue cover $C_0$ and first containerboard $C_1$ to each other.

Preferably, the positioning guide 58 brings into contact the first containerboard $C_1$, the second containerboard $C_2$ and the cover $C_0$ substantially simultaneously.

The coupling assembly 50 then outputs a multilayer corrugated cardboard in which the first containerboard $C_1$ is interposed between the cover $C_0$ and the second containerboard $C_2$. In detail, the corrugated cardboard exiting from the coupling assembly 50 comprises a lower layer formed by the second containerboard $C_2$, an intermediate layer formed by the first containerboard $C_1$ and an upper layer formed by the cover $C_0$. Consequently, the flat sheet of the second containerboard $C_2$ constitutes a first outer wall of the multilayer corrugated cardboard oriented towards the base surface 80, while the cover $C_0$ constitutes a second outer wall of the multilayer corrugated cardboard oriented opposite to the base surface 80.

The multilayer corrugated cardboard exiting from the coupling assembly 50 is input to the double baker 60. Preferably, the plane units 62 complete the drying of the glue applied by the gluing stations 52 and 54 of the coupling assembly and regulate a planarity of the multilayer corrugated cardboard, while the conveyor unit of the double baker 60 transfers the multilayer corrugated cardboard from the input end 64 to the output end 66 of the double baker.

At the output of the double baker 60 the multilayer corrugated cardboard is completely formed and can be subjected to other processes, for example die-cutting, by means of additional process assemblies (not shown), which may be included in the plant 10.

It will be readily apparent to the person skilled in the art that in the plant 10, the plane units 62 of the double baker 60 need to generate reduced heat, inasmuch as the humidity and the heat in the second containerboard $C_2$ are maintained (i.e., there is very little dispersion of heat and humidity) during the transfer from the corrugating unit 36 to the coupling assembly 50, through the transfer assembly 70.

Consequently, it is possible to maintain an intensity of heat, supplied by the double baker to the multilayer corrugated cardboard, lower than a value that would compromise the sheets that are closer to the heating elements of the plane unit 62 and to control the heating with greater precision, so as have a consistent heat distribution in the multilayer corrugated cardboard which traverses the double baker 60.

In addition, it will be readily apparent to the person skilled in the art that the second containerboard $C_2$, produced by the corrugating unit 36 of the second corrugating assembly 30, is transferred to the coupling assembly 50 and to the double baker 60 by the transfer assembly 70 which transfers it with a direction of motion substantially opposite to the direction of motion, imposed by the conveyor unit of the double baker 60, with which the first containerboard $C_1$ and the cover $C_0$ are transferred to the coupling assembly 50 and to the double baker 60, as well as to the direction of motion, imposed by the conveyor unit of the double baker 60, of the multilayer corrugated cardboard.

In other words, the transverse component (i.e., substantially parallel to the base surface 80) of the motion of the second containerboard $C_2$ has an opposite direction to the transverse components of the motions of the first containerboard $C_1$, of the cover $C_0$ and of the multilayer corrugated cardboard. The plant 10 in accordance with embodiments of the present invention produces a multilayer corrugated cardboard substantially free of defects due to humidity and/or an inconsistent removal thereof, using a single double baker 60.

Moreover, the structure of the plant 10 in accordance with embodiments of the present invention has an extremely compact linear extension, obtained without increasing its size in different spatial directions from the direction of development of the linear sequence. In particular, the structure of the plant 10 makes it possible to obtain a multilayer corrugated cardboard of high quality without requiring heating/humidifying stations and, in addition, without requiring a plurality of double bakers, brake assemblies and brake aligner assemblies.

The invention thus conceived is susceptible to many modifications and variants, all falling within the same inventive concept.

For example, in alternative embodiments (not shown), the plant is adapted to produce multilayer corrugated cardboard comprising three or more waves (i.e., corrugated sheets). For this purpose, the plant comprises an additional corrugating assembly, an additional transfer assembly and an additional gluing station in the coupling assembly for every containerboard included in the multilayer corrugated cardboard produced by the plant beyond the second.

In alternative embodiments (not shown), the first corrugating assembly, the second corrugating assembly and/or any additional corrugating assembly can be replaced with corresponding devices for storing and dispensing a preformed containerboard, like the aforementioned containerboard assemblies. In this way, heat and humidity supplied to the containerboard, during the operation of the containerboard assemblies, are substantially maintained until reaching the double baker thanks to the presence of the transfer assembly according to embodiments of the present invention. In other words, the transfer assembly substantially reduces the dispersion of humidity and heat from the containerboards that traverse it during their travel towards the double baker. At the same time, the transfer assembly maintains the containerboard that traverses it under tension and correctly aligned.

In some embodiments, devices can be implemented for controlling a rate of evaporation of the humidity and/or dispersion of the heat during the sliding of the second containerboard $C_2$ on the transfer unit 72 of the transfer assembly 70. For example, it is possible to implement for this purpose a forced ventilation system (not shown) at the transfer unit 72 of the transfer assembly 70.

It will also be observed that the plant 10 in accordance with embodiments of the present invention could be configured to operate activating only one of the corrugating assemblies 20 or 30. In this way, it is possible to produce a single layer corrugated cardboard by means of the plant 10.

Similarly, nothing prevents from implementing an alternative plant (not shown) in which one of the corrugating assemblies is not implemented. For example, nothing prevents from setting up an alternative plant comprising only the second corrugating assembly (i.e., the first corrugating assembly is omitted) to produce a single layer corrugated cardboard obtaining substantially the same advantages described above in the case of a plant for the production of multilayer corrugated cardboard. In particular, this plant makes it possible to obtain a single layer corrugated cardboard of high quality without requiring heating/humidifying stations and, in addition, without requiring a plurality of double bakers, brake assemblies and brake aligner assemblies.

Moreover, all of the details can be replaced by technically equivalent elements. In practice, the materials employed, as well as the contingent shapes and dimensions, may be any according to requirements, without thereby departing from the scope of protection of the claims that follow.

The invention claimed is:

1. A plant (10) for the production of corrugated cardboard comprising:

a corrugating unit (36) adapted to produce a containerboard, and a double baker (60) adapted to receive a multilayer corrugated cardboard, the double baker (60) comprising a conveyor unit adapted to convey the multilayer corrugated cardboard through the double baker (60) from an input end (64) to an output end (66) thereof, the conveyor unit of the double baker (60) imparting a sliding direction of the multilayer corrugated cardboard produced by the plant (10), the corrugating unit (36) being positioned at the output end (66) of the double baker (60), wherein the plant (10) further comprises a transfer unit (72) adapted to receive the containerboard and to move the containerboard, the transfer unit (72) comprising:

an input end (722) of the containerboard positioned adjacent the corrugating unit (36), an output end (724) of the containerboard positioned at an input end (64) of the double baker (60), the plant (10) further comprises:

an additional corrugating unit (26) adapted to produce an additional containerboard, the additional corrugating unit (26) being positioned at the input end (64) of the double baker (60), and a cover assembly (40) placed upstream of the additional corrugating unit (26), relative to the sliding direction of the multilayer corrugated cardboard produced by the plant (10).

2. The plant (10) according to claim 1, wherein the transfer unit (72) is positioned externally to the double baker (60).

3. The plant (10) according to claim 2, wherein the transfer unit (72) is adapted to receive the containerboard from the corrugating unit (36) to the input end (722) and to move the containerboard from the respective input end (722) to the respective output end (724) of the transfer unit (72).

4. The plant (10) according to claim 1, wherein the transfer unit (72) is adapted to receive and to move the containerboard with the corrugated sheet oriented towards a support plane of the transfer unit (72).

5. The plant (10) according to claim 4, further comprising a pair of corrugating assemblies (20, 30), each corrugating assembly comprising:

a respective corrugating unit (26, 36), and a pair of sheet storing units (22, 32), each storing unit (22, 32) being adapted to supply a respective sheet to the corrugating unit (26, 36), wherein the transfer unit (72) is superposed to a portion of a first corrugating assembly (20) and a portion of a second corrugating assembly (30) of the pair of corrugating assemblies (20, 30).

6. The plant (10) according to claim 5, wherein the corrugating assemblies (20, 30) are arranged in sequence with respective storing units (22, 34) positioned mutually adjacent, and wherein the transfer unit (72) is superposed to the mutually adjacent storing units (22, 34).

7. The plant (10) according to claim 5, further comprising:

a gluing assembly (52) for applying a glue on a surface of a corrugated sheet included in the containerboard, and an idler roller (74) positioned at both the output end (724) of the transfer unit (72) and the gluing station (52), the idler roller (74) being adapted to receive the containerboard from the transfer unit (72) and supply the containerboard to the gluing station (52).

8. The plant (10) according to claim 7, wherein each corrugating assembly (20, 30) comprises an additional idler roller (28, 38) positioned between the corrugating unit (26, 36) and a storing unit (22, 32), and wherein the idler roller (74) is positioned superposed to the additional idler roller (28) of the corrugating assembly (20) comprising the corrugating unit (26) positioned in proximity to at the input end (64) of the double baker (60).

9. The plant (10) according to claim 1, further comprising pressing elements adapted to maintain the containerboard stretched on the transfer unit (72) during movement of the containerboard.

* * * * *